United States Patent [19]

Aberg

[11] 4,413,827

[45] Nov. 8, 1983

[54] SCALED-DOWN GOLF COURSE GAME

[76] Inventor: Erik O. Aberg, Pensacola, Fla.

[21] Appl. No.: 173,366

[22] Filed: Jul. 29, 1980

Related U.S. Application Data

[63] Continuation of Ser. No. 955,218, Oct. 27, 1978, abandoned, which is a continuation-in-part of Ser. No. 947,572, Oct. 2, 1978, abandoned, which is a continuation of Ser. No. 869,161, Jan. 13, 1978, abandoned.

[51] Int. Cl.[3] ..... A63B 69/36

[52] U.S. Cl. ..... 273/176 AB; 273/199 R

[58] Field of Search ..... 273/199 R, 176 J, 176 AB, 273/176 R, 176 A, 176 AA, 176 E, 176 F, 176 FA, 176 FB

[56] References Cited

U.S. PATENT DOCUMENTS

| | | | |
|---|---|---|---|
| 3,427,030 | 2/1969 | Ward | 273/199 R X |
| 3,671,042 | 6/1972 | Garber | 273/176 J X |
| 3,940,145 | 2/1976 | Gentiluomo | 273/199 R X |
| 4,026,561 | 5/1977 | Baldorossi et al. | 273/199 R X |
| 4,145,053 | 3/1979 | Healey | 273/176 AB |

*Primary Examiner*—George J. Marlo

*Attorney, Agent, or Firm*—Lane, Aitken & Kananen

[57] ABSTRACT

A scaled-down golf course includes a plurality of golf holes, each hole including a first area designated as a driving tee, a second area provided as a putting surface and a fairway area located between the first and second areas. The course is adapted to be played with two types of balls, a fairway ball which is designed to resist long flight when struck by a golf club and a putting ball which is designed to have normal golf ball characteristics when chipped and putted. A stripe is provided at a designated distance from the periphery of each putting surface for indicating when the putting ball is to be substituted for the fairway ball. The use of red, white, yellow and orange balls by golfers participating in this game is preferred so they can readily identify their ball by the chosen color. The fairway area has a length which is scaled-down relative to the length of a fairway of a normal sized golf course by a factor which is the ratio of the distance the fairway ball can be driven relative to the distance a normal golf ball can be driven.

5 Claims, 3 Drawing Figures

SCALED-DOWN GOLF COURSE GAME

This is a continuation of U.S. application Ser. No. 955,218, filed Oct. 27, 1978, now abandoned, which in turn is a continuation-in-part of U.S. application Ser. No. 947,572, filed Oct. 2, 1978, now abandoned, which in turn is a continuation of U.S. application Ser. No. 869,161, filed Jan. 13, 1978, now abandoned.

BACKGROUND OF THE INVENTION

This invention relates to a form of miniature golf course and, more particularly, to a miniature golf course which is a scaled-down version of a normal sized golf course but which retains the characteristics of the normal golf course including having the same par and being played with the same clubs.

Miniature golf courses have become popular because less ground area is needed, a full round of golf can be played in significantly less time, and less physical exertion is required. However, most miniature golf courses are designed as public amusements and do not provide meaningful practice activity for regular golfers.

One example of a miniature golf course where an attempt has been made to overcome the disadvantages of most such courses is shown and described in U.S. Pat. No. 3,427,030 to Ward, where a practice golf ball is used on the fairways which are all 65 feet long instead of being different lengths as in a regular sized golf course. Since the practice ball can be driven 50–80 feet, a skilled golfer should be able to reach the green with one drive so that significantly fewer shots are required than on a regular course. Instead of hitting the ball on the fairway grass, mats are provided at various locations in the fairway so that the practice ball can be placed on the nearest mat for the next shot should the green not be reached with the original drive. The practice ball is replaced by a putting ball formed of solid polyurethane plastic when the practice ball reaches the green.

Another miniature golf course design is shown and described in U.S. Pat. No. 4,026,561 to Baldorossi et al where an oversized ball and clubs are provided which are said to simulate the feel of regulation equipment but which result in the ball traveling a relatively short distance when struck.

SUMMARY OF THE INVENTION

A miniature golf course which more closely simulates the characteristics of a regular golf course than those noted above is described below. A practice ball is used for teeing off and fairway shots but instead of forming all fairways with an equal length, a factor is determined which represents the ratio of the distance a practice ball can be driven relative to the distance a normal golf ball can be driven and then each fairway is scaled-down by that factor, with respective fairways being different lengths. The ball is teed off and driven from the surface of the fairway as is done on a normal sized golf course, but the ball travels the shorter scaled-down distance.

By using these scaled-down fairways and the practice ball, all of the characteristics of a normal golf course are simulated so that the same type and number of strokes are required and the same par is assigned as would be for a hole of a normal length.

When the fairway ball is driven to within a predetermined distance of the putting surface it is replaced by a normal golf ball or one which is designed to have a normal golf ball characteristics when chipped and putted. After that hole has been completed the golfer moves on to the next hole which is different from the first hole, such as the holes of a normal golf course, but which represents a scaled-down version of a second hole.

In this way, a miniature golf course is designed which provides a total simulation of a normal golf course, but is of a significantly smaller size. An accomplished golfer can practice all of his shots, including chip shots and putts with a normal ball, and can work on every phase of his game in less time with less exertion.

BRIEF DESCRIPTION OF THE DRAWINGS

Further details of these and other features and objects of the invention will become apparent when a detailed description of a preferred embodiment is considered along with the following drawings.

DETAILED DESCRIPTION OF A PREFERRED EMBODIMENT

Figure 1:
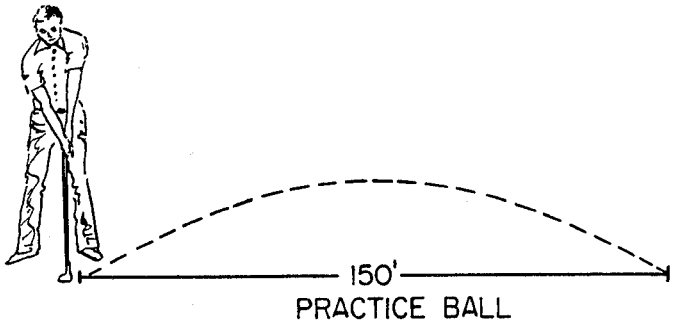
FIG. 1 is a schematic view of a golfer driving a golf ball and is illustrative of the distance a practice golf ball can be driven by an experienced golfer.

As will be seen from the following description, a miniature golf course designed in accordance with the subject invention will enable a golfer to practice all his normal shots, use the same clubs he would use on a regularly sized course, and play on a course with the same par as a regularly-sized course, but which is reduced in actual distance by significant degree. FIG. 1 shows a golfer in a driving stance and illustrates the distance that a practice ball can be driven by an experienced golfer with a normal swing of the club. For example, and merely for reason of illustration, the practice ball is shown as being capable of being driven approximately 150 feet. This distance is to be contrasted with the distance which a regular golf ball can be driven with the same normal swing of the club which is, for example and merely for reason of illustration, 600 feet as shown in FIG. 2.

It has been found that a practice ball which has the characteristics mentioned above and is suitable for use in the scaled-down course proportioned as described below can be a commercially available hollow polyethylene practice ball which weights about 6.5 gms. The weight can be changed to vary with the proportionate dimensions of the scaled-down course, the shorter the course, the lighter the ball should be.

Figure 2:
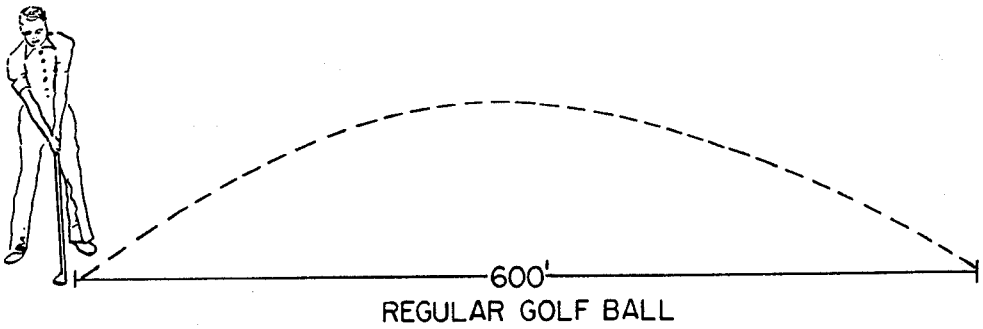
FIG. 2 is a schematic view similar to FIG. 1 but is illustrative of the distance a normal golf ball can be driven by an experienced golfer.

When comparing the balls shown in FIGS. 1 and 2, a regular golf course can be scaled-down by the ratio of the distance the practice ball can be driven relative to the distance the regular ball can be driven with basically the same stroke which is 150:600 or about 1:4. The scaled-down golf course has its fairways reduced in accordance with that ratio so that the golf course will cover significantly less land area but be covered in the same number of strokes when the practice ball is used. The greens, on the other hand, can remain essentially the same size or be reduced in size by some small amount.

With the scaled-down course, the practice ball will be used on the fairways and the same number of strokes which would normally be used on a regularly-sized golf course will be used in approaching the green. When the ball falls within a certain specified distance of the periphery of the green, for example about 20 feet, the practice ball can be replaced by a regular golf ball and a normal chip shot can be used to reach the green. A white stripe can be provided to indicate when the balls are to be exchanged. In this way, a scaled-down golf course is provided which enables a golfer to use the clubs he would normally use in playing a regular golf course with the same number of strokes involved, only the distance from the tee to the green being different. Thus, each of the holes of the scaled-down golf game has a par value of the corresponding hole of the normal sized golf course.

The use of red, white, yellow and orange balls by golfers participating in this game is preferred so they can readily identify their ball by the chosen color.

Figure 3:
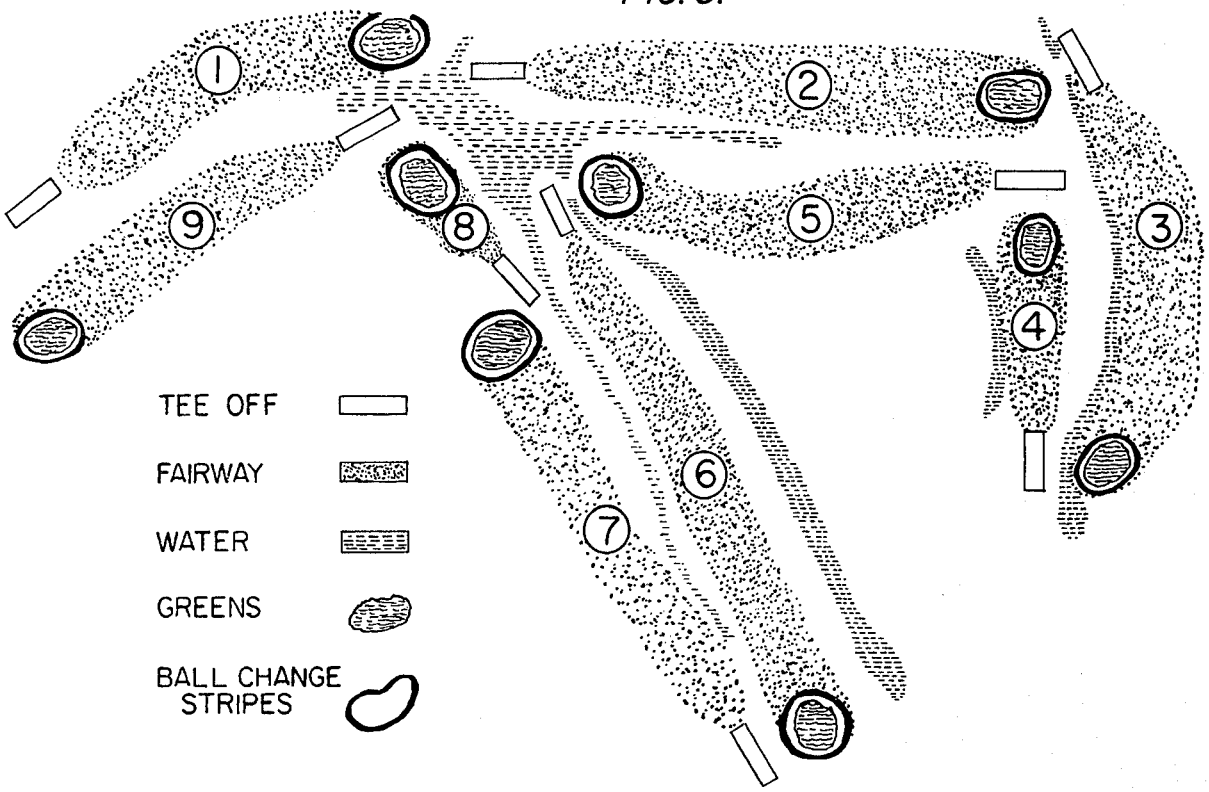
FIG. 3 is a schematic representation of a nine-hole golf course designed in accordance with the invention.

By way of example, a golf course is shown in FIG. 3 which represents a scaled-down version of the championship golf course at Perdido Bay Country Club in Pensacola, Florida, which has on the first nine holes the distance indicated in the following table:

1. 1056'
2. 1419'
3. 1140'
4. 490'
5. 1134'
6. 1515'
7. 1230'
8. 376'
9. 1036'

When the golf course shown in FIG. 3 is scaled-down in accordance with the present invention the same nine holes will have the distances in the following table:

1. 264'
2. 355'
3. 285'
4. 123'
5. 284'
6. 379'
7. 308'
8. 94'
9. 259'

Since the fairway distances are proportional to the regular championship course the same par for each hole will remain in effect. As can be seen, the scaled-down course has all of the advantages of a regular golf course, but combines those advantages with the fact that the fairway distances are significantly shorter and a normal golf ball is used when the golfer is within chipping range of the greens. Each hole is designed differently, as with a regular golf course, the only difference being that the distances are scaled-down in accordance with the ratio between the distance a practice ball can be driven relative to the distance a regular ball can be driven. With such a scaled-down course the entire course can be built under one roof within an area of about 200 feet by 500 feet, if the holes are appropriately arranged.

Thus, a scaled-down golf course is provided which combines the best features of a regular golf course with advantages of a smaller course. It should be understood that improvements and modifications can be made to the instant invention by one with ordinary skill in the art and all such improvements and modifications are contemplated as falling within the scope of the appended claims.

What is claimed is:

1. A scaled-down golf game designed to be played with normal golf clubs, comprising:

a plurality of golf holes having various par values, each hole including a first area designated as a driving tee, a second area provided as a putting surface and a fairway area located between the first and second areas, two types of balls, of normal golf ball size, one being a fairway ball which is designed to resist long flight when struck by a golf club and the other being a putting ball which is designed to have normal golf ball characteristics when chipped and putted, the driving characteristics of said balls being such that the fairway ball can be driven about one-fourth the distance the putting ball can be driven with the same stroking force, the fairway area for each hole having a length which is scaled-down relative to the length of a fairway of a corresponding hole of a normal sized golf course by a factor which is the ratio of the distance the fairway ball can be driven relative to the distance said putting golf ball can be driven, whereby each of the holes of the scaled-down golf game has a par value equal to the par value of the corresponding hole of the normal sized golf course, and an indication means provided at a designated distance from the periphery of the putting surface for indicating when the putting ball is to be substituted for the fairway ball, the indication means comprising a stripe located a designated distance from the periphery of the putting surface, whereby chipping may be performed using the putting ball designed to have normal golf ball characteristics when chipped.

2. The golf game of claim 1, wherein the fairway area has a scaled-down length relative to the length of a fairway of a normal sized golf course of about 1:4.

3. The golf game of claim 1, wherein nine separate holes are provided.

4. The golf game of claim 1, wherein the stripe is located about twenty feet from the periphery of the putting surface.

5. A scaled-down golf game, accurately simulating the playing of golf at a regulation golf course, to be played with the full complement of normal golf clubs, comprising:

a plurality of nine or more golf holes having a normal range of various par values, each golf hole having a driving area at a predetermined distance from a putting surface and a fairway area therebetween, a normal golf ball to be used on the putting surface and adjacent thereto when within a normal chipping distance, and a fairway ball which resists long flight so that when struck by a normal golf club, the fairway ball traverses a distance approximately proportional to the distance a normal golf ball would traverse under like conditions, the driving characteristics of said balls being such that the fairway ball can be driven about one-fourth the distance the putting ball can be driven with the same stroking force, the fairway ball being used from the driving area and on the fairway, the fairway area for each hole thus having a length which is scaled down relative to the length of the fairway area of a corresponding hole of a regulation golf course by a factor which is the ratio of said approximately proportional distance, such distance being about 1:4, said golf course thus being such that a nine hole course can fit within an area of about 200 to about 500 feet, and means in the form of a stripe located at a designated distance from the periphery of each putting surface for indicating a chipping distance location on said fairway for the player to switch from the fairway ball to the putting ball, whereby each of the holes of the scaled-down golf course has a par value equal to the par value of the normal-sized golf course.

* * * * *